US007510492B2

(12) United States Patent
Hudson

(10) Patent No.: US 7,510,492 B2
(45) Date of Patent: Mar. 31, 2009

(54) BASKETBALL RETURN NET WITH PIVOT WINGS

(76) Inventor: Glenn E. Hudson, 4 Brandy Ct., Mackinaw, IL (US) 61755

( * ) Notice: Subject to any disclaimer, the term of this patent is extended or adjusted under 35 U.S.C. 154(b) by 0 days.

(21) Appl. No.: 11/345,039

(22) Filed: Jan. 31, 2006

(65) Prior Publication Data

US 2006/0183571 A1 Aug. 17, 2006

Related U.S. Application Data

(60) Provisional application No. 60/647,760, filed on Jan. 31, 2005.

(51) Int. Cl.
*A63B 69/00* (2006.01)

(52) U.S. Cl. ..... 473/433; 473/479; 473/447

(58) Field of Classification Search ..... 473/432, 473/433, 447, 472, 479–489; 273/317.3
See application file for complete search history.

(56) References Cited

U.S. PATENT DOCUMENTS

| | | | | |
|---|---|---|---|---|
| 3,901,506 | A * | 8/1975 | Caveney | 473/433 |
| 4,869,502 | A | 9/1989 | Wares | |
| 4,913,431 | A | 4/1990 | Jakobs | |
| 5,129,648 | A * | 7/1992 | Sweeney et al. | 473/433 |
| 5,183,253 | A | 2/1993 | Grimaldi | |
| 5,681,230 | A | 10/1997 | Krings | |
| 5,971,873 | A | 10/1999 | Balducci | |
| 6,267,696 | B1 | 7/2001 | Mabe | |
| 6,458,049 | B2 | 10/2002 | Bush | |
| 6,595,877 | B2 | 7/2003 | Pearson | |
| 6,746,348 | B2 | 6/2004 | Barnes | |
| 6,752,728 | B1 | 6/2004 | Tien | |

* cited by examiner

*Primary Examiner*—Mitra Aryanpour
(74) *Attorney, Agent, or Firm*—Michael Berns; Maloney, Parkinson & Berns

(57) ABSTRACT

A basketball return net assembly that allows the net to be positioned to return the basketball in a set direction. The assembly may attach to a basketball backboard and can be adjusted to point the net in different directions.

4 Claims, 7 Drawing Sheets

BASKETBALL RETURN NET WITH PIVOT WINGS

CROSS-REFERENCE TO RELATED APPLICATION

This application claims the benefit of U.S. Provisional Application 60/647,760, filed Jan. 31, 2005, which is incorporated herein by reference.

BACKGROUND OF THE INVENTION

The present invention relates to a backstop to be used with a basketball backboard. A net helps keep the ball near the user and helps return the basketball back toward the user.

SUMMARY OF THE INVENTION

This invention provides a basketball return net that allows adjustment of the net. The shape and direction of the rebounding net can be altered be pivoting wings on lateral sides of the basketball backboard. This allows the user or shooter to make shots in different areas of the court, not just the free throw line.

DETAILED DESCRIPTION OF THE INVENTION

Figure 1:
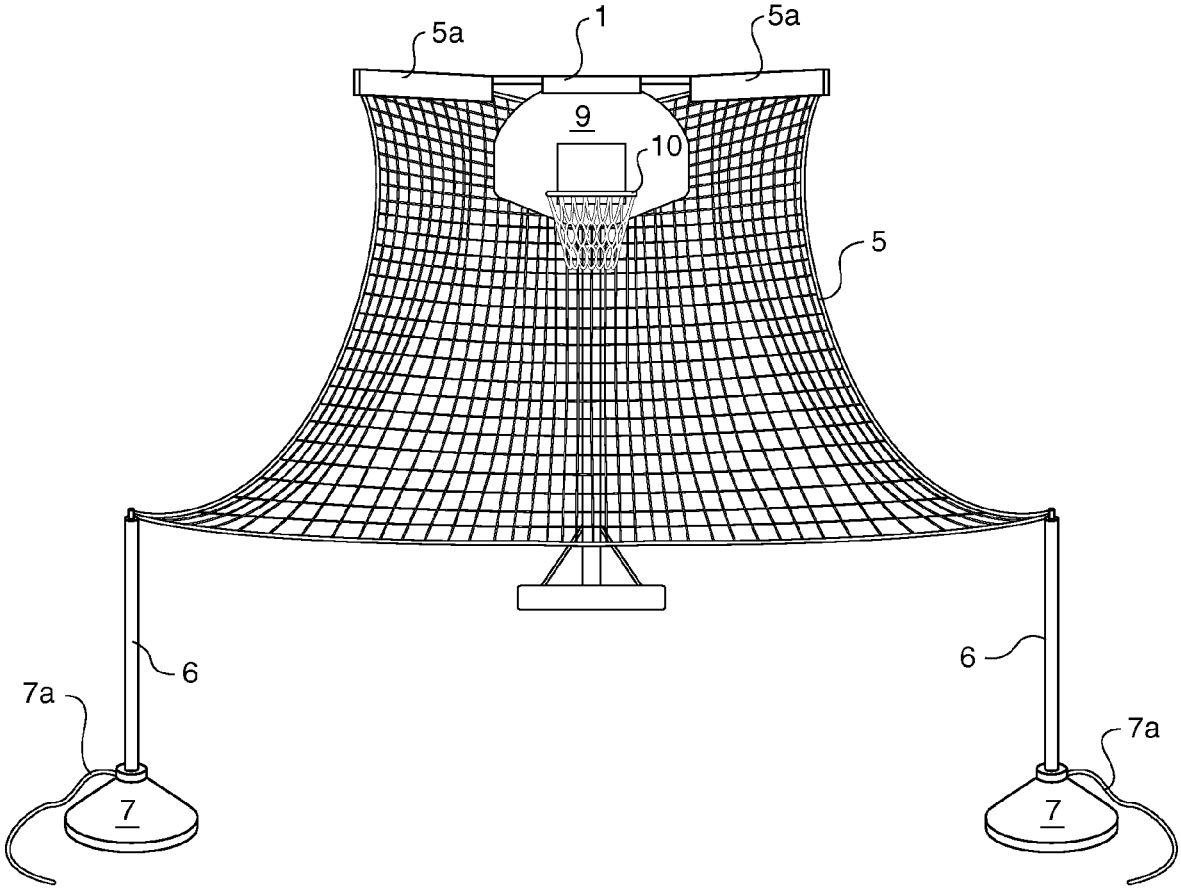
FIG. 1 is a front view of an embodiment of the invention mounted on a rounded basketball backboard and extending forward.

This invention provides a portable backstop primarily designed to be used as a backstop/rebounder of both made and missed basketball shots taken by a basketball shooter and to return the basketball to or near the location of the shooter or shooters on the basketball court.

The invention uses the most efficient method available for providing a large backstop/rebounder/screen that is capable of catching and returning most shots of a basketball shooter from any shooting angle (either to the right or to the left side of the front of the backboard or directly in front of the backboard's basket) of the front side of a basketball backboard and hoop.

The invention is an apparatus designed to attach to the top portion of a basketball backboard, and facilitates the supporting of a net, screen, divider or barricade which can surround the basketball backboard including the extended area on both the left and right side of the front of the backboard as well as below the backboard downward, forward and extending to the ground or a piece of equipment sitting on the ground.

The apparatus consists of a middle channel section that attaches to the top part of the backboard, two adjustable extension channel sections that attach to the middle section and enable the apparatus to work with any width backboard, two support wings that attach to the extension channel sections using a method that allows the two support wings to rotate forward and backwards from the extension channel, two brackets that attach to the extension channel sections and that secure the two support wings so they can pivot and slide into place, a net, screen, divider or barricade with two sleeves that are supported by sliding the sleeves over the two support wings, and weights or bases and extension pole standards that can be used to secure the net towards the ground.

In some instances the two adjustable extension channel sections can be replaced by a longer middle channel section whereby the two outside ends of the middle channel are used to attach the two brackets and pivoting support wings to the middle channel in place of the adjustable extension channel sections.

The support wings, when not supporting the net, have a slot down the middle of them to allow them to slide inwardly to compactly store against the middle channel and the two extension channels. This allows for compact storing of the apparatus whether on the top part of the backboard or when being stored somewhere while not in use.

The outside wings rotate forward and backward, and support the hanging weight of the net, screen, divider or barricade. The net, screen, divider or barricade attaches to the outside support wings and can form a portable wall parallel to the backboard or by rotating the outside support wings forward can form a right angle or two right angles to the backboard providing a wall (on the front side of the backboard) on either side or both sides of the basketball hoop. The bottom portion of the net, screen, divider or barricade can be rotated in conjunction with the outside wings in a fashion to facilitate a basketball rebounding return that returns the basketball to any side of the area in front of the basket.

An alternative method of using the invention is to incorporate the invention/apparatus as part of the design of a basketball backboard. To do this, a part of the basketball board can be designed to take the place of the middle channel section and the two adjustable extension channel sections of the invention/apparatus with the two outside support wings directly attaching to the alternatively designed backboard. The outside support wings, which can be rotated forward and backward) attach directly to the backboard instead of the adjustable extension channel sections (which are eliminated by the alternative design) of the apparatus. The other components of the invention/apparatus (net, screen, divider, or barricade, and weights or pieces of equipment) all facilitate the same basketball backstop/rebounder functions as the attachable apparatus as previously discussed.

REFERENCE NUMERALS USED IN THE FIGURES

The following is a numbered list of parts that can be associated with the numbers listed in the Figures:

1 Middle Channel a. Clamp bolts to secure middle channel to backboard.

2 Adjustable Extension Channel a. Bolts and nuts to attach adjustable extension channel

3 Bracket to secure support wing with slot
  a. Bolts and nuts to attach bracket to adjustable extension channel
  b. Clamp bolt to screw into bracket and insert into support wing with slot
4 Support wing with slot
5 Net
  a. Sleeve of net
6 Extension pole standards
7 Base
  a. Rope/strap to move base
8 Collapsible base
  a Collapsible base tube insert
  b. Rope/strap to move base
9 Basketball backboard
10 Basketball rim
11 Weights to secure net to the ground or surface

DETAILED DESCRIPTION OF THE FIGURES

FIG. 1 shows the apparatus attached to a fan shaped basketball backboard and the two support wings rotated slightly forward with the net fully pulled forward and supported by the two extension pole standards and two weighted plastic bases.

Figure 2:
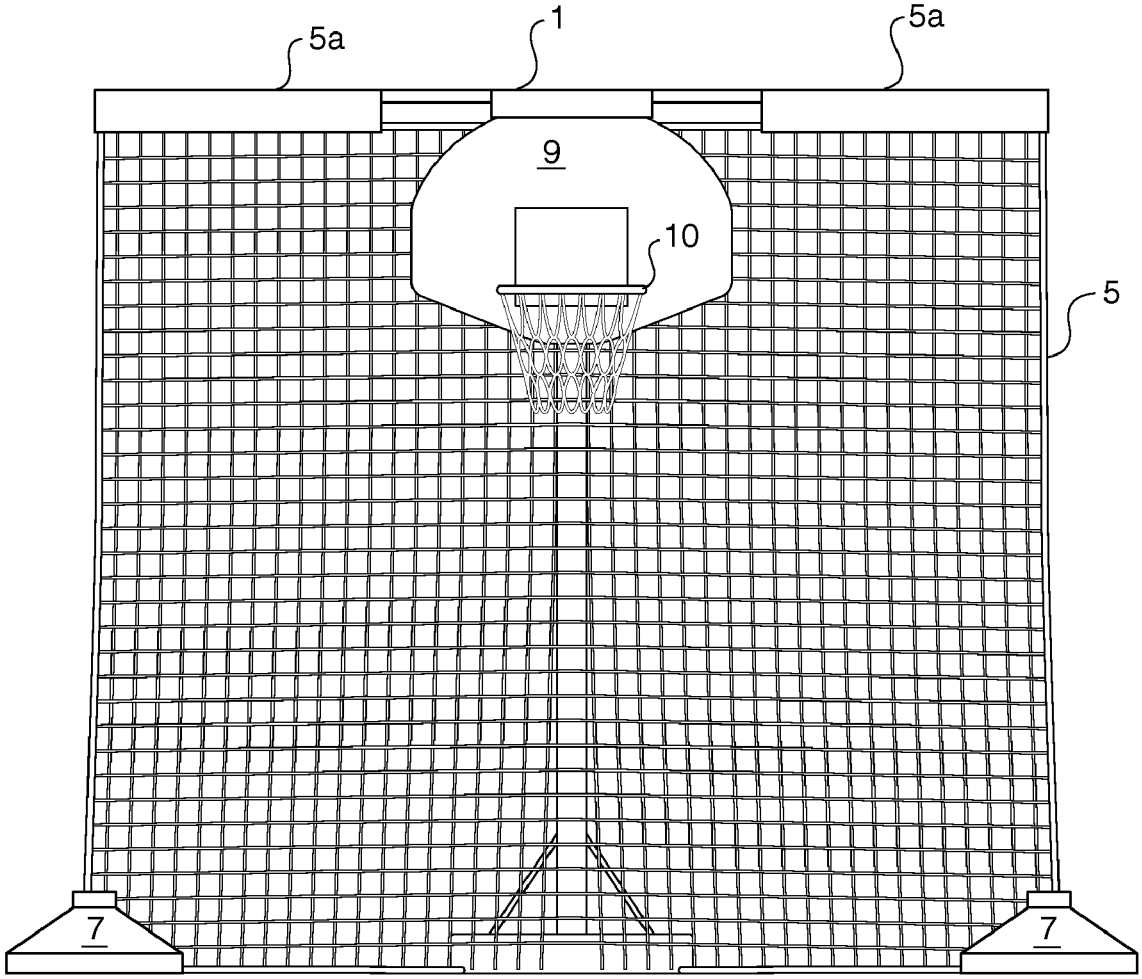
FIG. 2 is a front view of an embodiment of the invention extending downward.

FIG. 2 shows the apparatus attached to a fan shaped backboard and the two support wings parallel to the backboard with the net hanging down to the ground behind the backboard.

Figure 3:
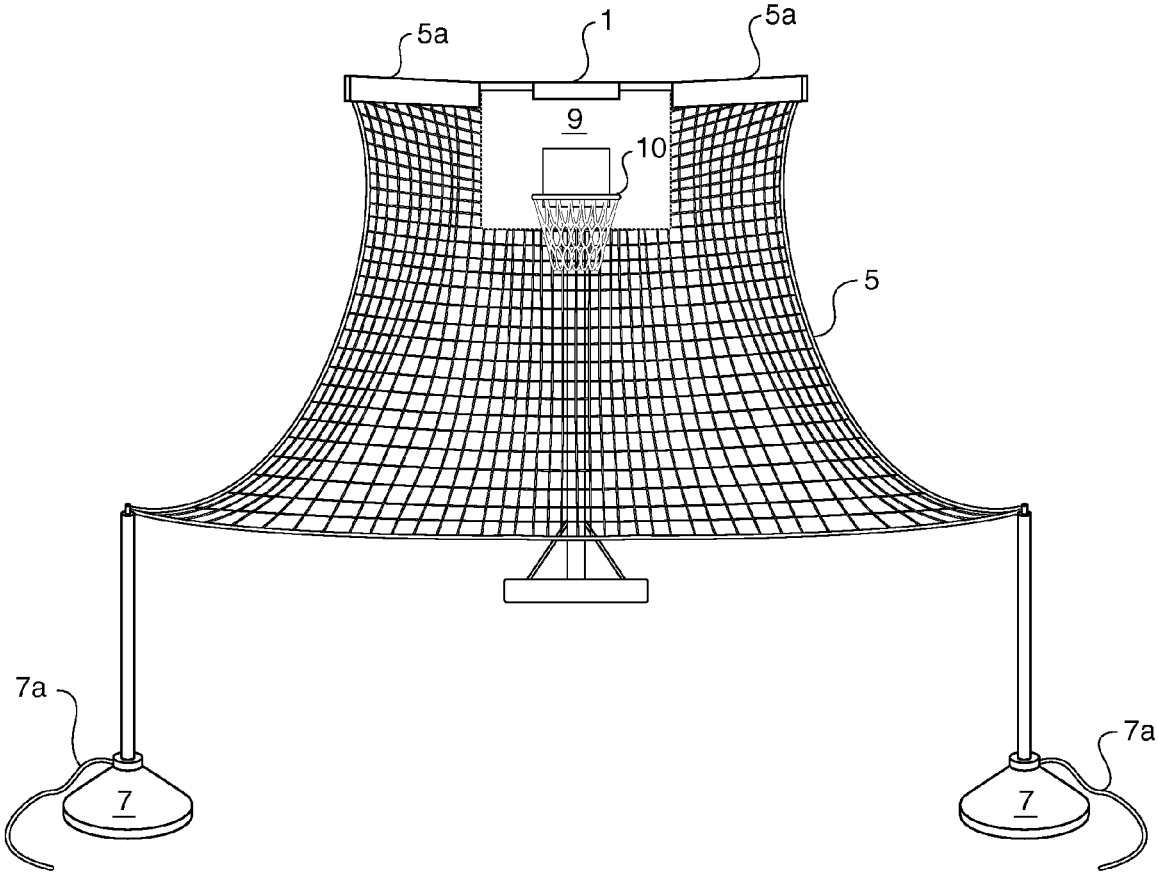
FIG. 3 is a front view of an embodiment of the invention mounted to a squared basketball backboard and extending forward.

FIG. 3 shows the apparatus attached to a rectangular backboard and the two support wings rotated slightly forward with the net sloping forward such that a basketball will roll forward down the net.

Figure 4:
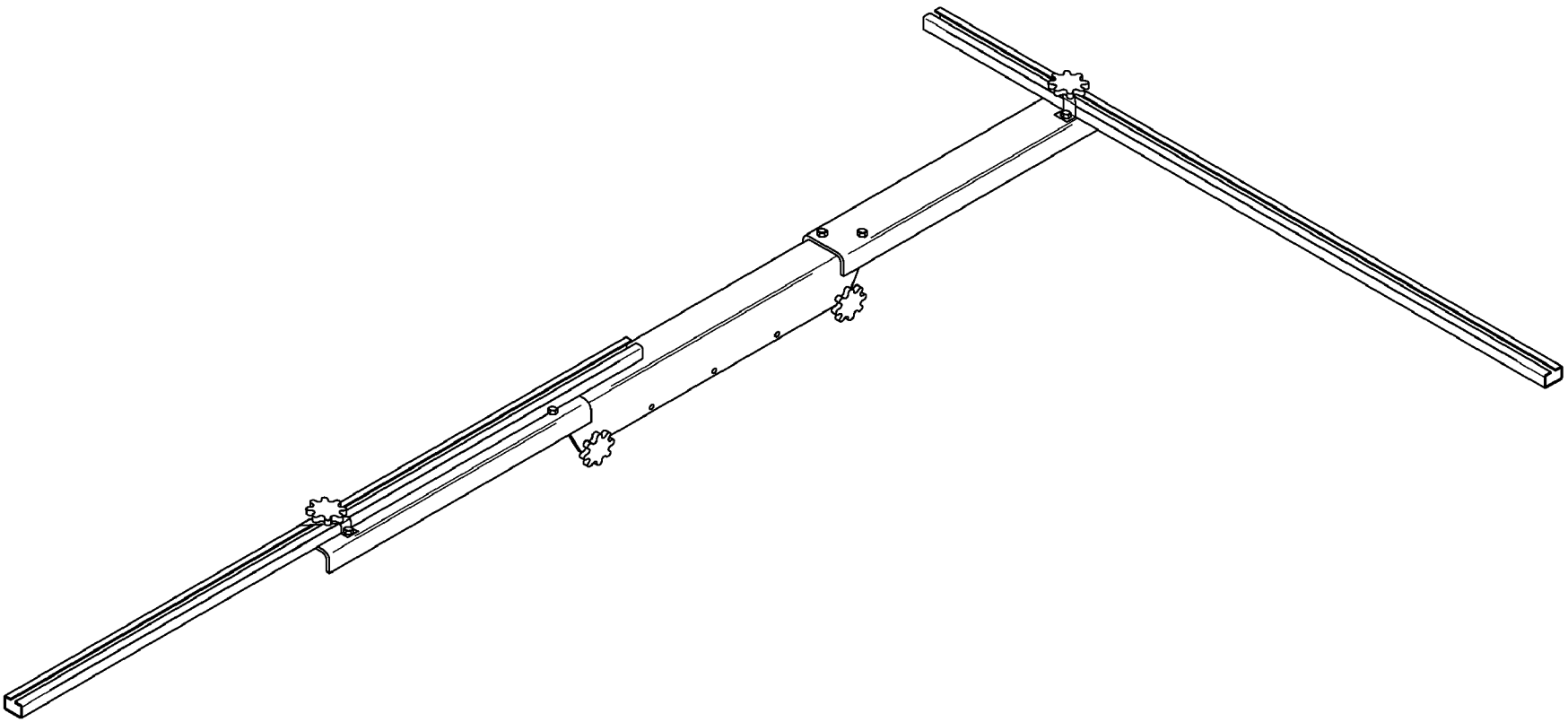
FIG. 4 is a rear view of the apparatus components that attach to the basketball backboard to support the net.

FIG. 4 shows a back view of the apparatus, mechanical portion of the invention, which attaches to the backboard. The support wing, to the right, has been rotated to a ninety degree angle of the middle channel and two adjustable extension channels. The support wing, to the left, has been slid out parallel to the middle channel and two adjustable extension channels.

Figure 5:
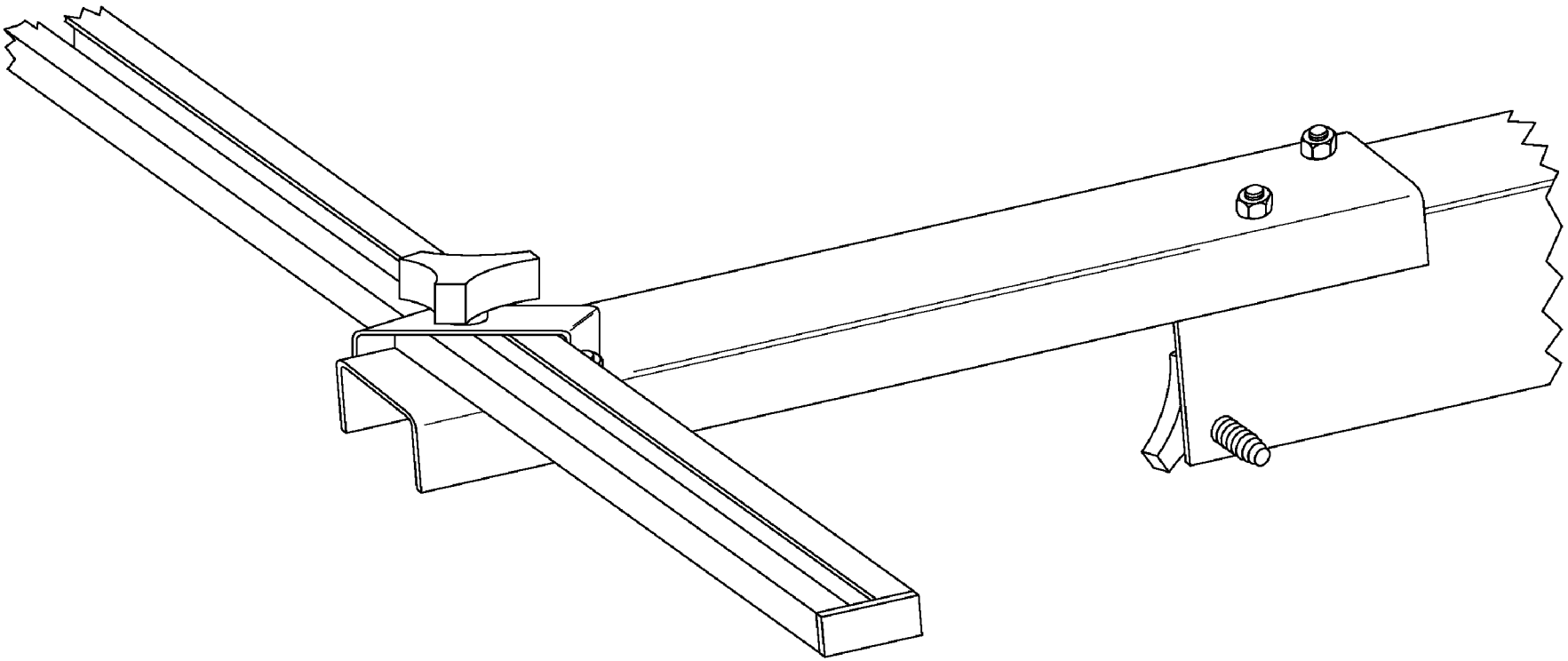
FIG. 5 is a detail view of the apparatus component connections that enable the apparatus to adjust to various size basketball backboards, as well as enabling the pivoting of the support wings.

FIG. 5 shows a close up front view of one side of the apparatus, mechanical portion of the invention, which attaches to the basketball backboard. The support wing with slot has been rotated to a ninety degree angle of the middle channel and two adjustable extension channels. Each support wing with slot fits under the bracket and on top of one of the adjustable extension channels and uses a clamp bolt screwed into the middle of the slot to allow it to pivot (rotate) and slide into its various positions.

Figure 6:
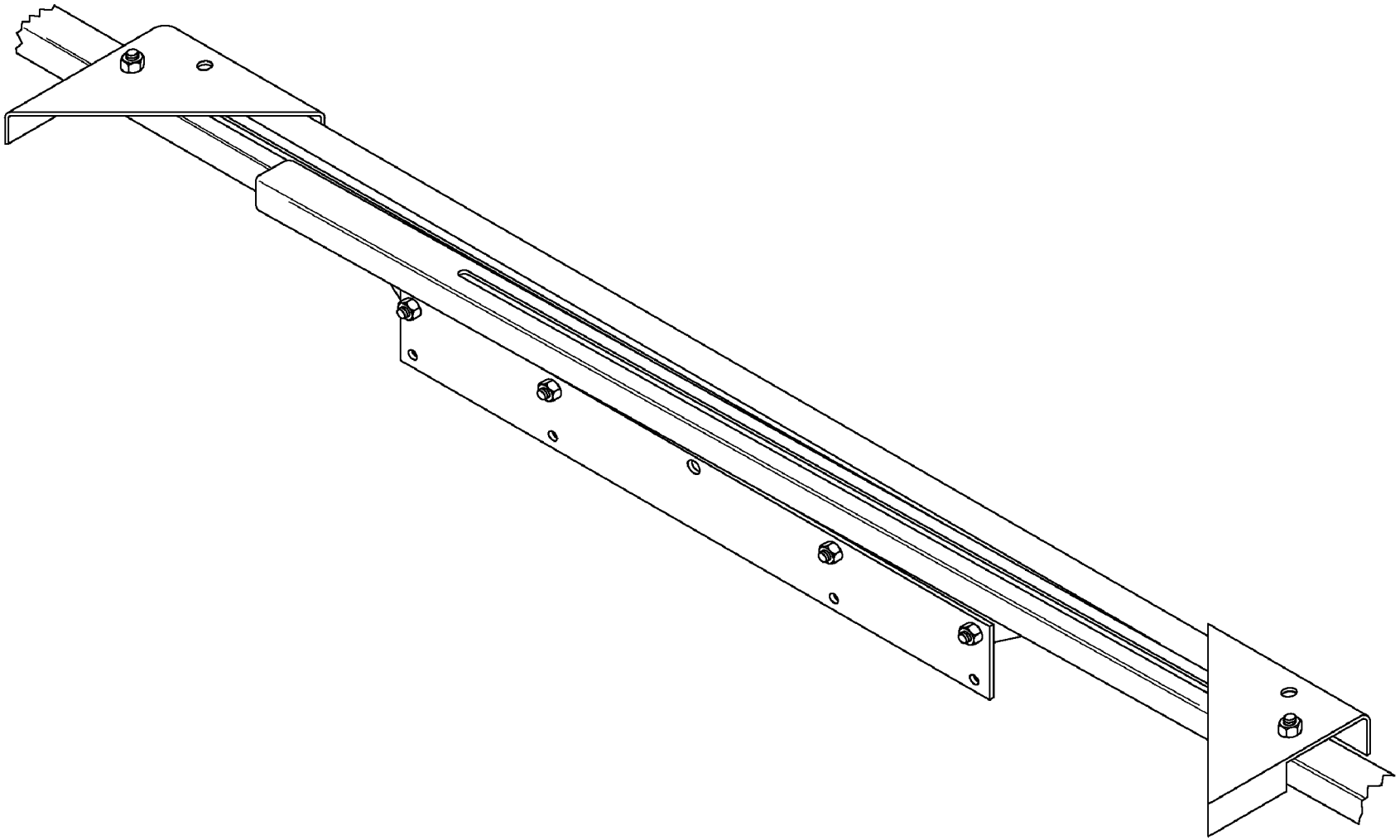
FIG. 6 is a rear view of the apparatus components with both support wings compactly slid in against the middle channel.

FIG. 6 shows a back view of an alternate embodiment of the apparatus, mechanical portion of the invention, which attaches to the backboard. This shows the two support wings with slots both slid into and on top of the middle channel.

Figure 7:
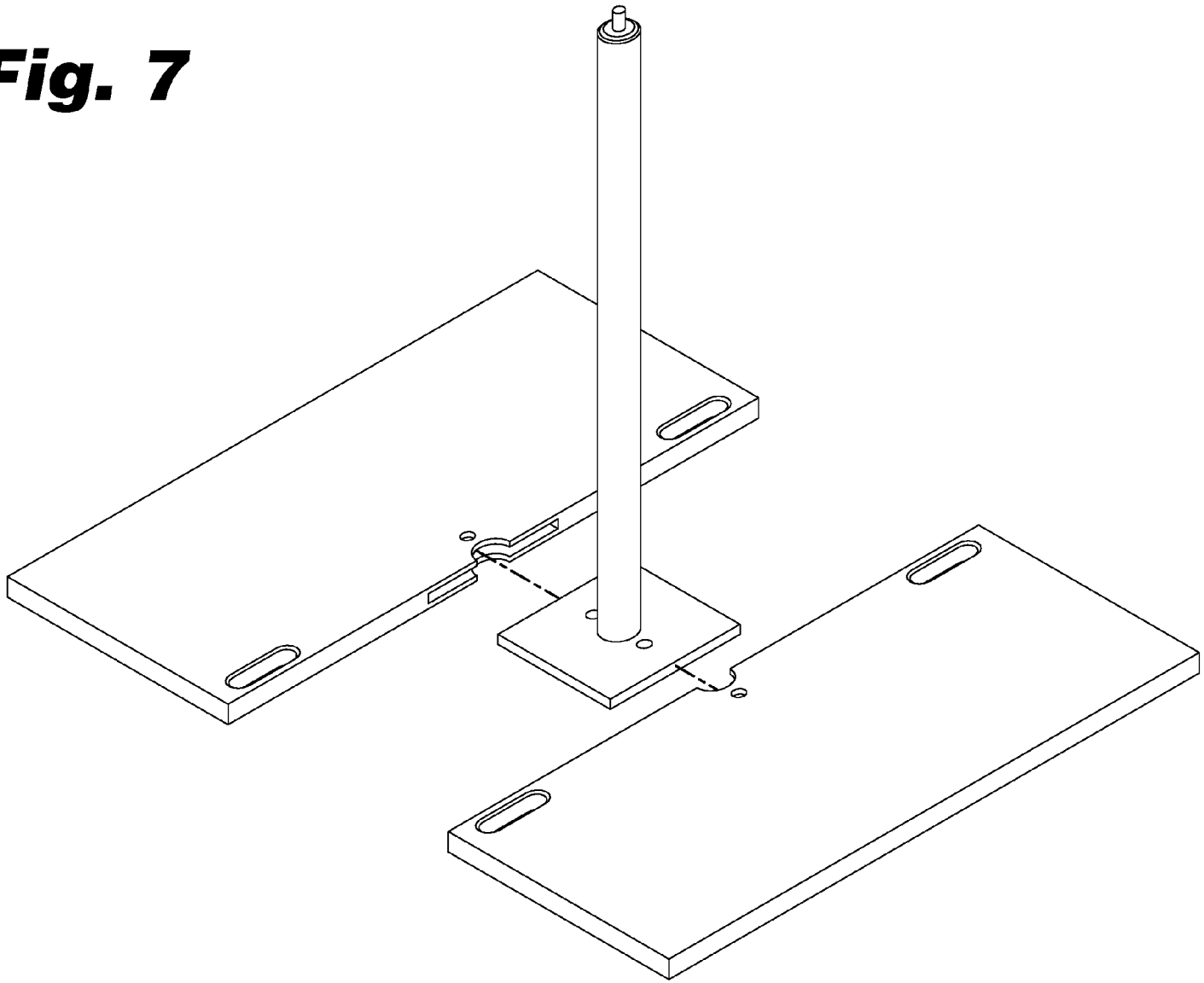
FIG. 7 is a detail view of the components of a portable base with an insert that can be used in conjunction with weights to support the extension pole standards that support the net.

FIG. 7 shows an exploded view of a collapsible base with a tube insert that is used to support the extension pole standard. The drawing shows two 8 inch by 16 inch collapsible bases that are flat on the bottom and top except for the inside the dotted area where a 4 inch slot is located and a half collar that is of a size that allows the tube portion of the collapsible tube insert to fit inside it. The 4 inch square base of the collapsible base tube insert fits in the slot of one side of the collapsible base and then the other side of the collapsible base slides over the other side. The 2 holes on opposite sides of the tube insert match up with the 2 holes on the plastic base collar which rises above the flat portion of the two sides of the collapsible bases to surround the tube insert. A bolt and nut through these 4 matched up holes locks the tube insert into the plastic base. Each outside corner of the collapsible base nearest the side with the 4 inch by 4 inch slot has a hole all the way through the plastic so a rope or strap to bind the two matching sides together. Also, 1 side of these combined collapsible bases can be used to attach a rope or strap to pull bases into position. This collapsible base with tube insert combined with any type of weight such as a vinyl, nylon or plastic bag with sand which sits on top of the flat portion of the bases can be used to support the extension pole standards that support the net away from the backboard and near to the ground or basketball court surface.

It will be readily understood by those persons skilled in the art, that the present invention is susceptible to broad utility and application in changing light bulbs. Many embodiments and adaptations of the present invention, other than those described, as well as many variations, modifications, and equivalent arrangements, will be apparent from or reasonably suggested by the present invention and foregoing description thereof, without departing from the substance or scope of the invention.

While the foregoing description illustrates and describes exemplary embodiments of this invention, it is to be understood that the invention is not limited to the construction and design disclosed herein. The invention can be embodied in other specific forms without departing from the true invention.

What is claimed is:

1. A basketball return net assembly attachable to a basketball backboard having a basketball hoop comprising:

a net having an upper edge;

at least one middle member attached to the backside of the basketball backboard and extending from beyond one outer edge of the basketball hoop to beyond the other outer edge of the basketball hoop on the opposite side of the basketball backboard;

at least two arm members attached to the ends of the at least one middle member and extending laterally on opposite sides of the basketball hoop;

wherein the upper edge of the net is supported in a laterally extended position by the at least two arm members on each side of the at least one middle member;

wherein each arm of the at least two arm members is independently pivotable of the other arm of the at least two arm members, from an angle parallel with the backboard towards the hoop to an angle perpendicular to the backboard;

means for independently pivoting the at least two arm members at a pivot point attached to the at least one middle member;

at least one lower support member positioned on a basketball playing surface, the at least one support member having sufficient weight to handle a force exerted by a basketball on the net and the net rebounding the basketball to the playing surface;

means for extending the at least one lower support member upwardly or downwardly with respect to the base on the basketball playing surface;

means for attaching the net to the at least two arm members; and means for supporting the net at various heights below the basketball hoop.

2. A basketball return net assembly according to claim 1, wherein the net may be released from the at least one lower support member and the at least two arm members are pivoted to a position generally parallel with the basketball backboard, allowing the net to fall downward behind the basketball backboard.

3. A basketball return net assembly according to claim 1, wherein the net may be released from-the at least one lower support member and the at least two arm members, and the at least two-arm members are retracted to abut against the at least one middle member to be compactly stored on top of the basketball backboard.

4. A basketball return net assembly according to claim 1, wherein the basketball return net assembly is attachable to the top of the basketball backboard.

* * * * *